US005909754A

United States Patent [19]

Oh

[11] Patent Number: 5,909,754

[45] Date of Patent: Jun. 8, 1999

[54] SHOWER UNIT

[75] Inventor: Il-Mook Oh, Kyunggi-Do, Rep. of Korea

[73] Assignee: Kwang-Woo, Seoul, Rep. of Korea; a part interest

[21] Appl. No.: 08/878,658

[22] Filed: Jun. 19, 1997

[30] Foreign Application Priority Data

| | | | |
|---|---|---|---|
| Jun. 20, 1996 | [KR] | Rep. of Korea | 96-16563 |
| Sep. 30, 1996 | [KR] | Rep. of Korea | 96-31830 |
| Dec. 5, 1996 | [KR] | Rep. of Korea | 96-68738 |
| Dec. 30, 1996 | [KR] | Rep. of Korea | 96-63368 |

[51] Int. Cl.[6] ..... A46B 13/04

[52] U.S. Cl. ..... 15/29; 15/22.1; 15/24

[58] Field of Search ..... 4/570, 606, 615; 15/21.1, 22.1, 24, 29, 97.1

[56] References Cited

U.S. PATENT DOCUMENTS 4,202,501 5/1980 Haynes .
5,246,301 9/1993 Hirasawa .

*Primary Examiner*—Terrence R. Till
*Attorney, Agent, or Firm*—Reising, Ethington, Barnes, Kisselle, Learman & McCulloch P.C.

[57] ABSTRACT

A shower unit is disclosed, including a compressor for producing high-pressure air for used with a water supply; a rotator driven by the high-pressure air; an injector positioned near the rotator to inject tap water; and a cleaning unit driven directly by the rotator. The inventive shower unit also includes a grip portion having the rotator and the injector, a switch for operating the rotator, and a valve for controlling the flow of the water sprayed through the injector.

11 Claims, 16 Drawing Sheets

SHOWER UNIT

BACKGROUND OF THE INVENTION

1. Field of the Invention

The present invention relates to a shower unit. More particularly, it relates to a shower unit having an injector that forces tap water to flow out of the shower unit, and a rotator which rotates a cleaning unit with high-pressure air, in a grip portion of the shower unit.

2. Description of the Prior Art

When we take a bath, we usually splash water over our bodies first, and then apply soap thereon to remove impurities created on the skin by sweat and dirt. We rub down our bodies with a towel or something, and rinse dirt out of the towels with clean water. Such a bath requires a good deal of effort and requires a lot of time. Particularly, removing corneous layers on elbows or heels is difficult for us.

In addition, massaging the body or washing clothes by hand, takes much time and labor. When it comes to tasks of bathing, massaging, laundering, etc. that require a lot of water, we usually have to use an extension hose for the water supply.

SUMMARY OF THE INVENTION

The present invention is intended to overcome the above-mentioned and numerous other disadvantages and deficiencies of the prior art.

Therefore, it is a first object of the present invention to provide a shower unit which can perform a cleaning operation, simultaneously supplying water used for cleaning body, massaging the body, or washing clothes.

It is a second object of the present invention to provide a shower unit which controls the flow of water and the motion of its cleaning unit to be properly used for each of the various tasks.

It is a third object of the present invention to provide a shower unit which makes little noise during operation.

In order to achieve the above-described objects of the present invention, there is provided a shower unit including a compressor for producing high-pressure air for use with water supply; a rotator driven by the high-pressure air; an injector positioned near the rotator to inject tap water; and a cleaning unit driven directly by the rotator.

According to a further aspect of the present invention, this shower unit further includes a grip portion having the rotator and the injector, a switch for operating the rotator, and a valve for controlling the flow of the water sprayed through the injector.

According to yet a further aspect of the present invention, the injector has an outlet facing the cleaning unit, and the outlet is formed around the rotary shaft of the rotator.

According to yet a further aspect of the present invention, the injector has an outlet facing the cleaning unit, and the outlet is formed on the grip portion.

According to yet a further aspect of the present invention, the injector has an outlet disposed at the opposite side of the rotator, facing the cleaning unit.

According to yet a further aspect of the present invention, the cleaning unit is formed of brushes.

According to yet a further aspect of the present invention, the shower unit further includes a coupling member for transmitting a rotating force of the rotator to the cleaning unit.

According to yet a further aspect of the present invention, the coupling member is used for converting the rotary motion of the rotator into the straight-line reciprocating motion of the cleaning unit parallel to the rotary shaft of the rotator.

According to yet a further aspect of the present invention, the coupling member is used for converting the rotary motion of the rotator into the straight-line reciprocating motion of the cleaning unit orthogonal to the rotary shaft of the rotator.

According to yet a further aspect of the present invention, the coupling member is used for converting the rotary motion of the rotator into a revolving motion of the cleaning unit with respect to the rotary shaft of the rotator.

According to yet a further aspect of the present invention, the coupling member is used for converting the rotary motion of the rotator into the rotary motion of the cleaning unit with respect to the rotary shaft of the rotator.

According to yet a further aspect of the present invention, a silencer is positioned at an air exit of the injector to reduce air noise that drives the rotator and is then discharged to the outside.

BRIEF DESCRIPTION OF THE DRAWINGS

The present invention may be better understood and its numerous objects and advantages will be more apparent to those skilled in the art by reference to the accompanying drawings in which.

DETAILED DESCRIPTION OF THE PREFERRED EMBODIMENTS

Figure 1:
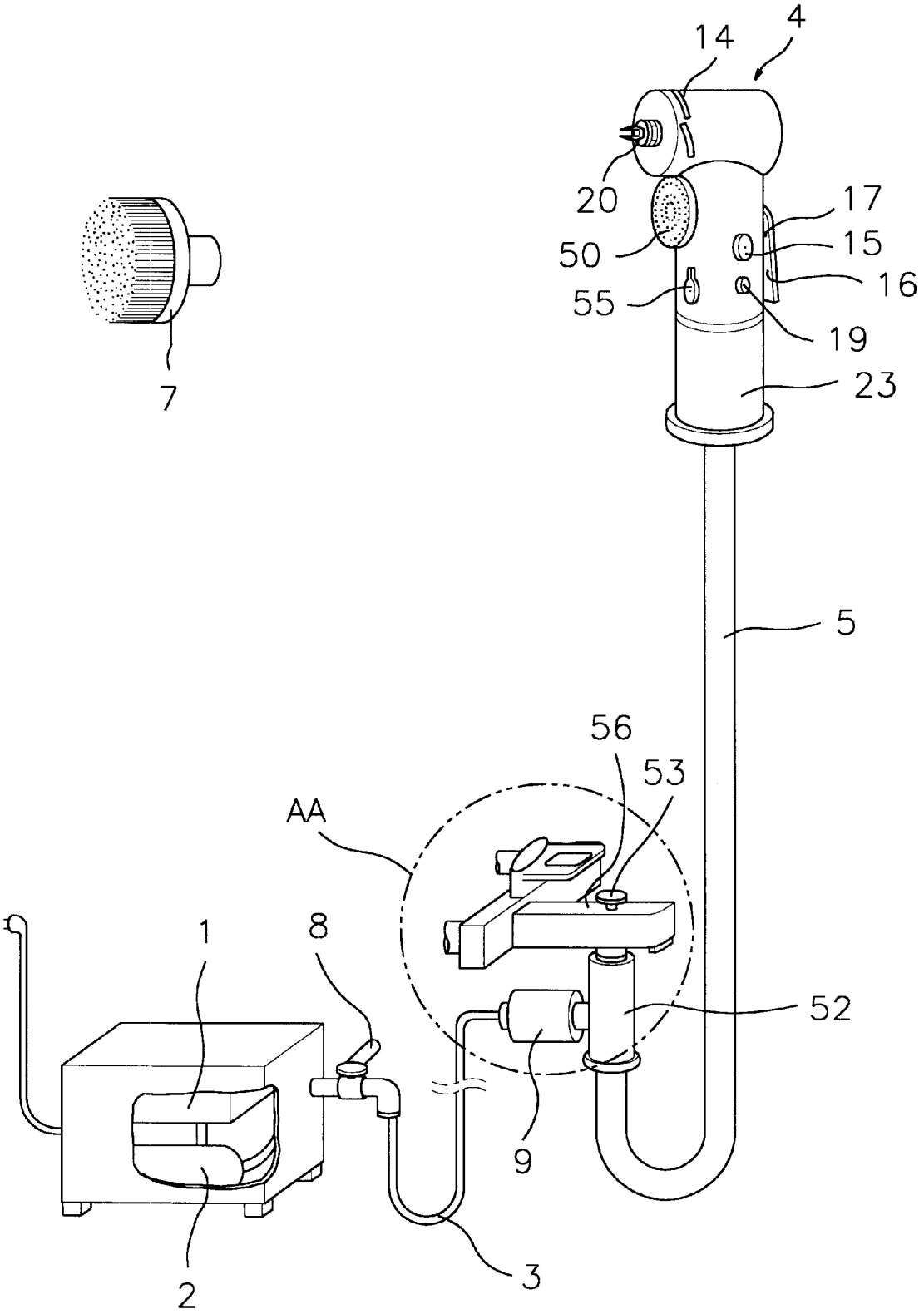
FIG. 1 is an exploded-perspective view of a shower unit in accordance with the present invention.
Figure 2:
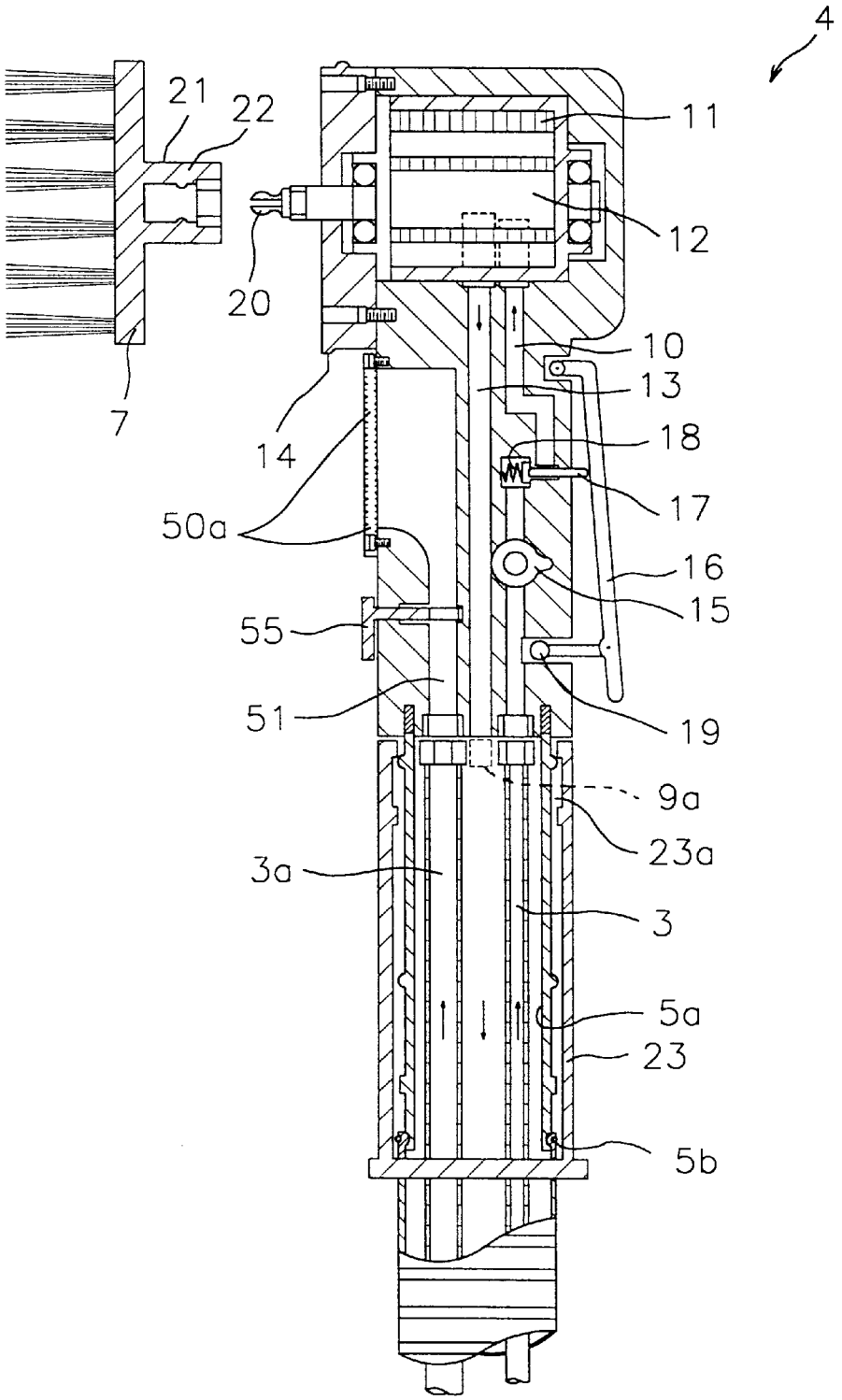
FIG. 2 is an enlarged longitudinal-sectional view of the shower unit's grip portion coupled with a cleaning unit.

FIGS. 1 and 2 each depict a shower unit in accordance with the present invention.

The shower unit includes a compressor 1 that increases the pressure of air used for water injection, a tank 2 which stores the air compressed by the compressor 1, an air supply tube 3 through which the compressed air output from the tank 2 flows, and a rotator 4 that rotates the compressed air transmitted from the air supply tube 3.

The shower unit also includes an injector 50 that is disposed under the rotator 4 and has a plurality of orifices 50*a* through which the water, supplied from a tap 56, is jetted out, a connector pipe 5 that discharges the compressed air used for driving the rotator 4, and a cleaning unit 7 which is detachably connected to one side of the rotator 4.

A control valve 8 is housed in the tank 2 to control the output of the compressed air stored in the tank 2, and a sliding member 23 is formed on an upper portion of the connector pipe 5 to be slidable along the connector pipe 5.

Referring to FIG. 2, the rotator 4 is used as an air supply passage 10 that is connected to one side of the air supply tube 3 to make the compressed air flow, and a rotary shaft 12 which turns by a driving force output from a blade 11, rotating by the compressed air transmitted through the air supply passage 10. The rotator 4 also includes an exhaust passage 13 through which the compressed air, used for driving the rotary shaft 12, is discharged, a water passage 51 connected to one side of a water supply tube 3*a* to make the tap water flow, and a regulating valve 55 which is formed in the middle of the water passage 51 and either makes the water from the water supply tube 3*a* flow to the injector 50 or cuts off the water.

A valve 15 is formed in the middle of the air supply passage 10 to control the flow of air that is supplied to the blade 11 through the air supply tube 3 with a ball (not illustrated) having a hole. A hingable open/close lever 16 is provided near the valve 15. An open/close valve 17 is provided to the air supply passage 10 to either supply the compressed air from the air supply tube 3 to the air supply passage 10 by the open/close lever 16 or cut off the compressed air. The open/close valve 17 closes the air supply passage 10 by using elastic force of a spring 18. In addition, a lever locking button 19 is provided to make the open/close lever 16 constantly press the open/close valve 17 so that the compressed air is furnished to the blade 11, if necessary.

On the projected stage of the rotary shaft 12, a ball-shaped connector 20 with an elastic slit of "−" or "+" type is formed. When the connector 20 fits into the cleaning unit 7 to be joined, bosses 22, provided to the insertion hole 21 of the cleaning unit 7, reduce the slit width of the connector 20, and the slit is elastically expanded, thus securely connecting the cleaning unit 7 with the connector 20.

Figure 3:
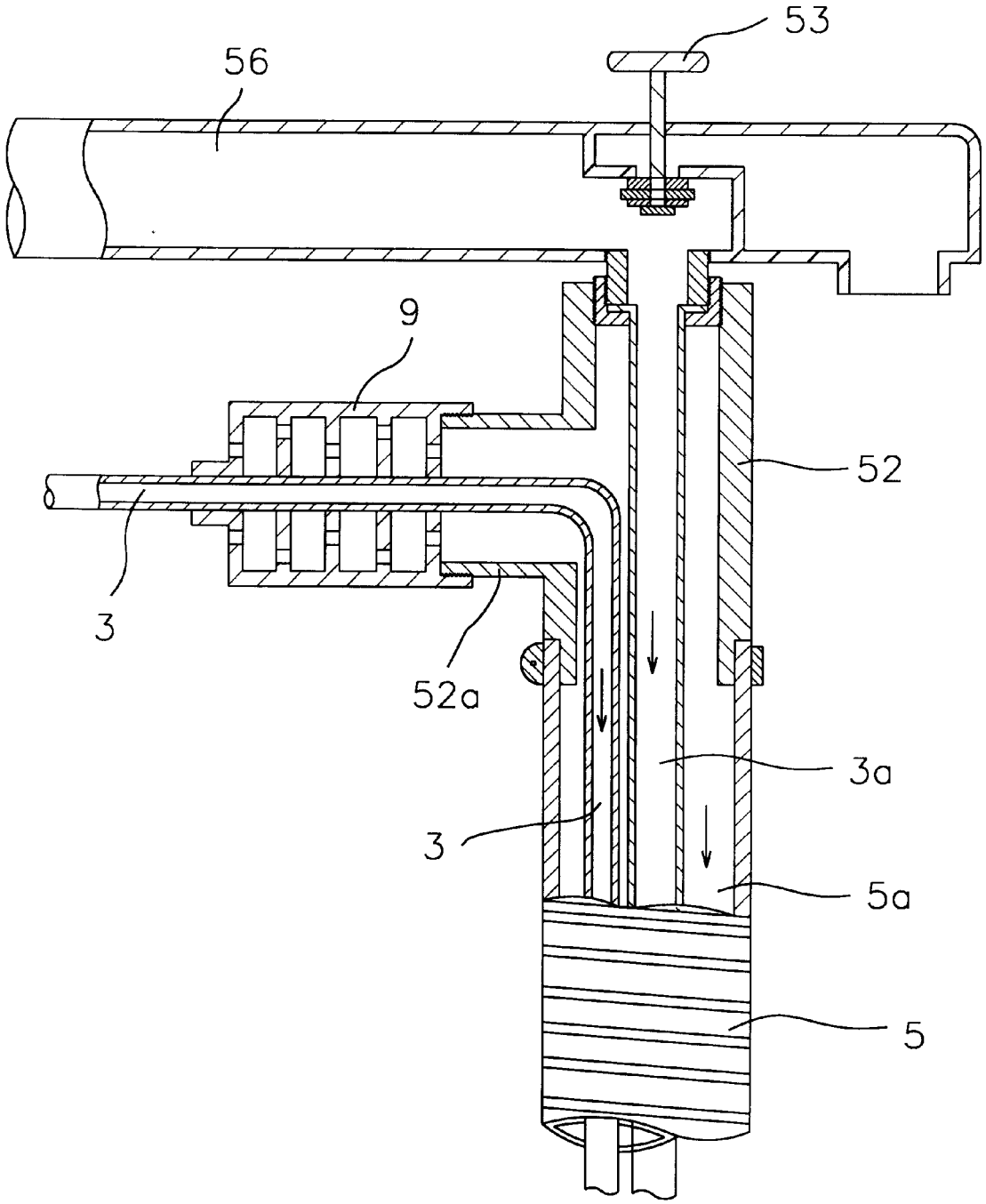
FIG. 3 is an enlarged-sectional view of FIG. 1.

FIG. 3 is an enlarged sectional view showing the connector pipe 5 that is formed around the air supply tube 3 and water supply tube 3*a* that is connected with the tap 56 through a T-connector pipe 52. A water supply valve 53 is installed within the tap 56 to either supply water from the tap 56 to the water supply tube 3*a* or cut off the water. The air supply tube 3 is inserted through a path 52*a* of the T-connector pipe 52, and a silencer 9 is provided to the end of path 52*a*. This silencer 9 is used to reduce noise created when the compressed air that drives the rotary shaft 12 is discharged to the outside through an exhaust tube 5*a*. As shown in FIG. 2, another silencer 9*a* is provided to the output part of the exhaust passage 13, i.e. upper end of the sliding member 23.

FIGS. 4A to 4H each depict a cleaning unit 7 in accordance with various preferred embodiments of the present invention.

Figure 4A:
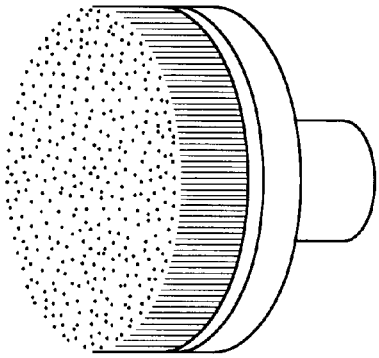
FIGS. 4A to 4H are each perspective views of a cleaning unit in accordance with various preferred embodiments of the present invention.
Figure 4B:
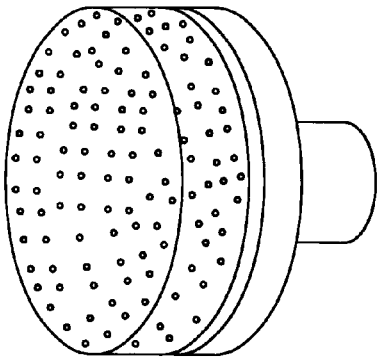
Figure 4C:
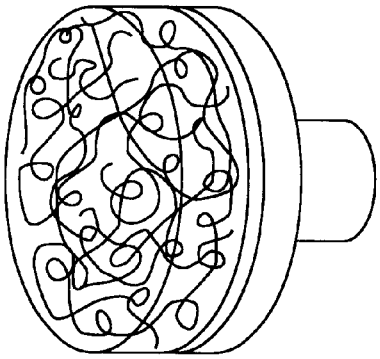
Figure 4D:
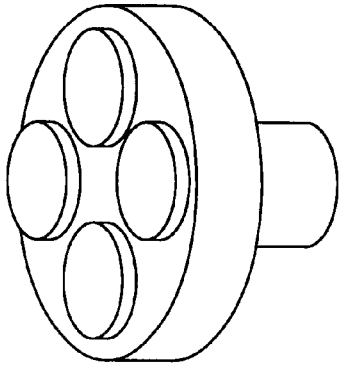
Figure 4E:
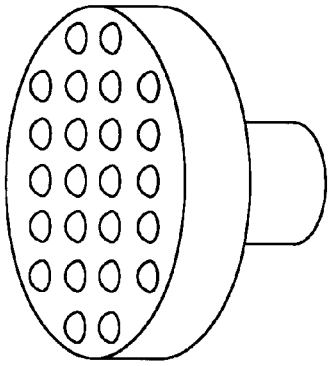
Figure 4F:
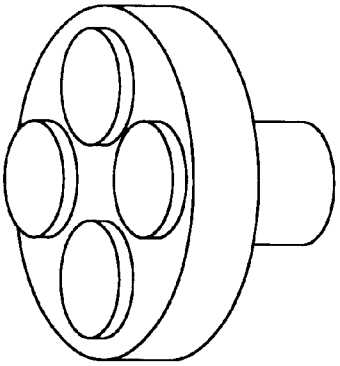
Figure 4G:
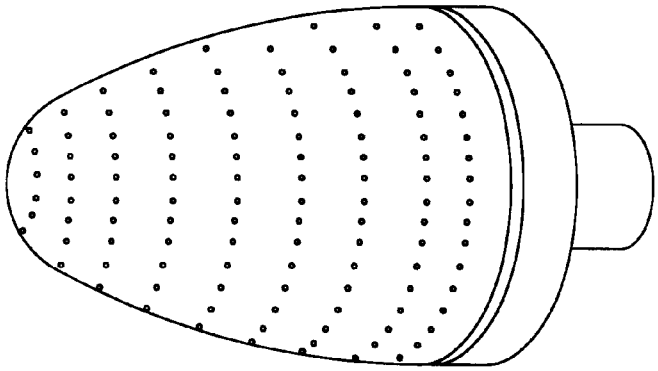
Figure 4H:
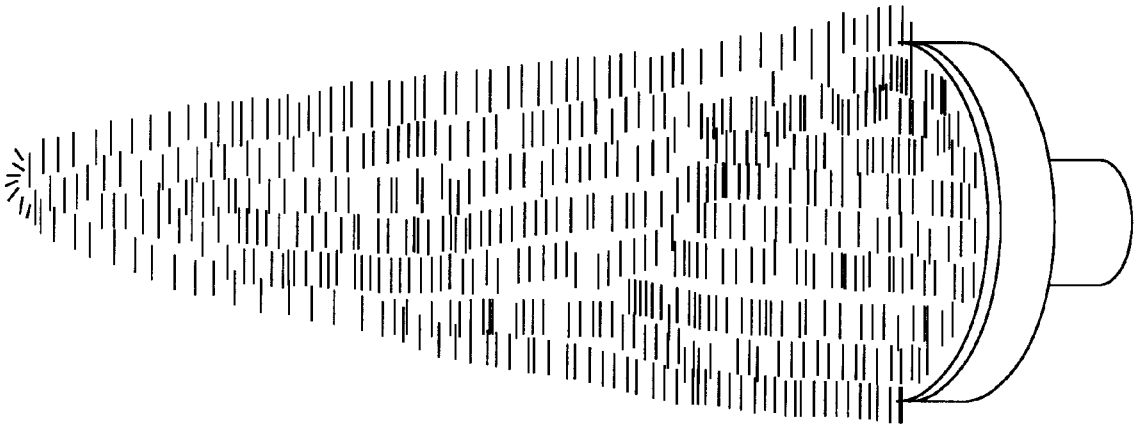

FIG. 4A illustrates a cleaning unit planted with brushes, and FIG. 4B shows a cleaning unit with a sponge. A cleaning unit with a vegetable sponge is depicted in FIG. 4C. FIGS. 4D and 4E are cleaning units with disk-shaped bosses and small semicircular bosses, respectively. A cleaning unit of FIG. 4F has round-shaped rotatable bosses, and another cleaning unit with small bosses formed on its tapered outer surface is depicted in FIG. 4G. A cleaning unit of FIG. 4H has brushes on its tapered outer surface. The above-described cleaning units may be selectively used according to a user-desired task such as skin cleansing, removal of corneous layers on elbows or heels, or laundering.

Figure 5A:
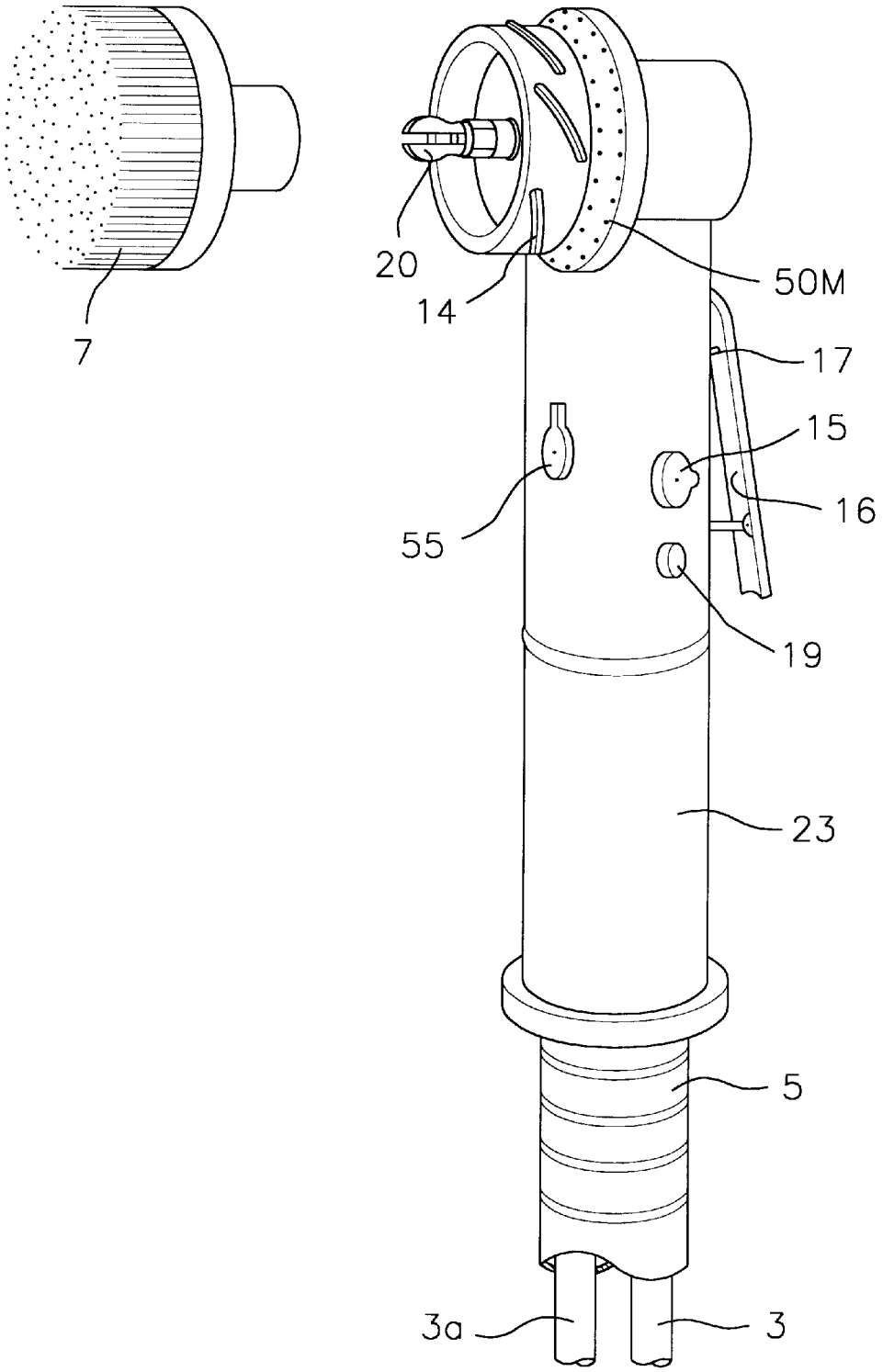
FIGS. 5A and 5B are each perspective views of an injector installed on different spots of the inventive shower unit.
Figure 5B:
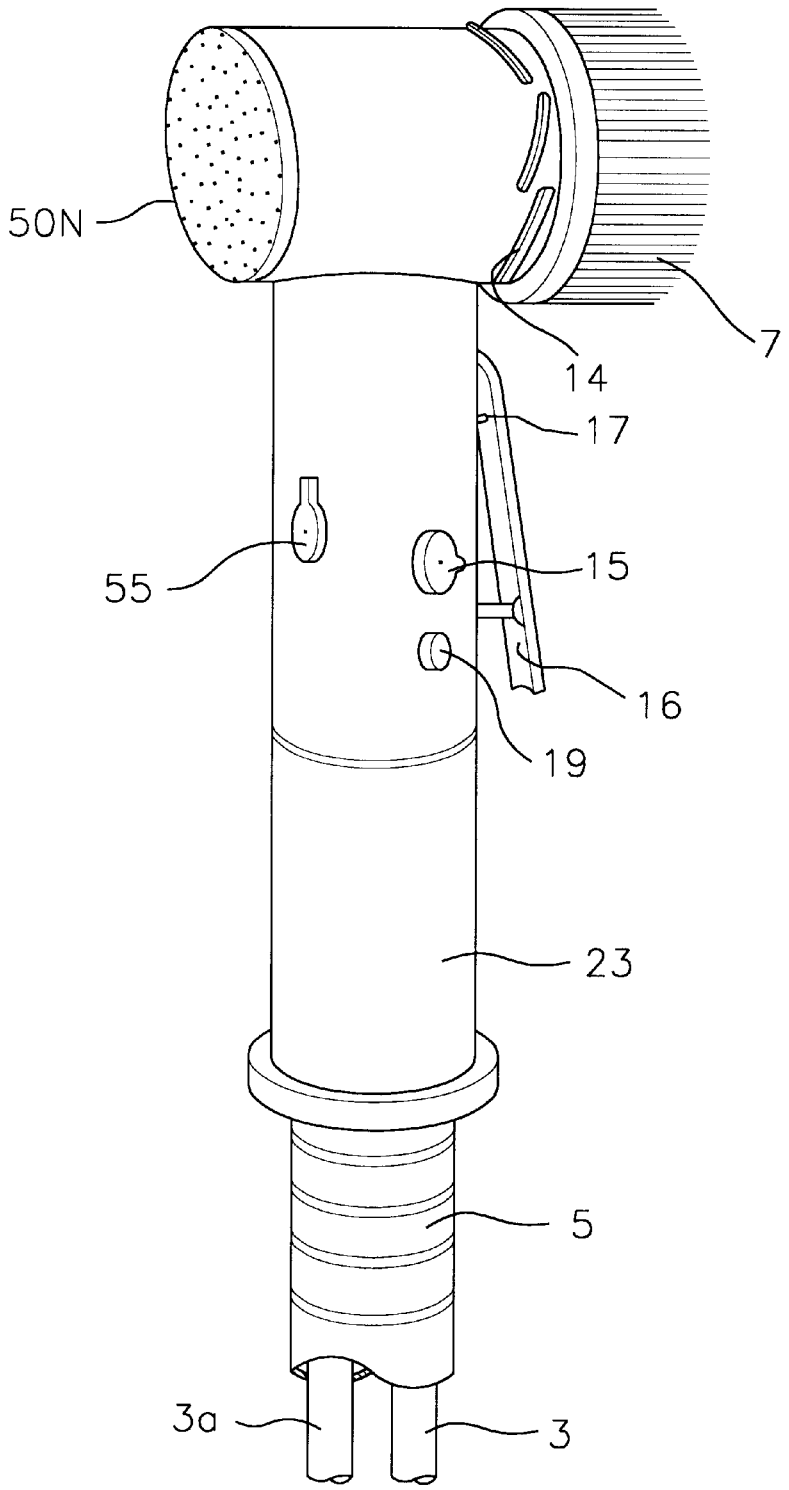

Referring to FIG. 5A, an injector 50M is formed around a connector 20, facing the front of a rotator 4 that is coupled with a cleaning unit 7, and a cleaning unit 7 of FIG. 5B has an injector 50N positioned facing the rear of a rotator 4.

In the above shower units, a coupling member is interposed between the rotator 4 and the cleaning unit 7 so the rotary motion of the rotary shaft 12 can be converted to various motions of the cleaning unit 7. Various preferred embodiments of this coupling member are depicted in FIGS. 6 to 11.

Figure 6A:
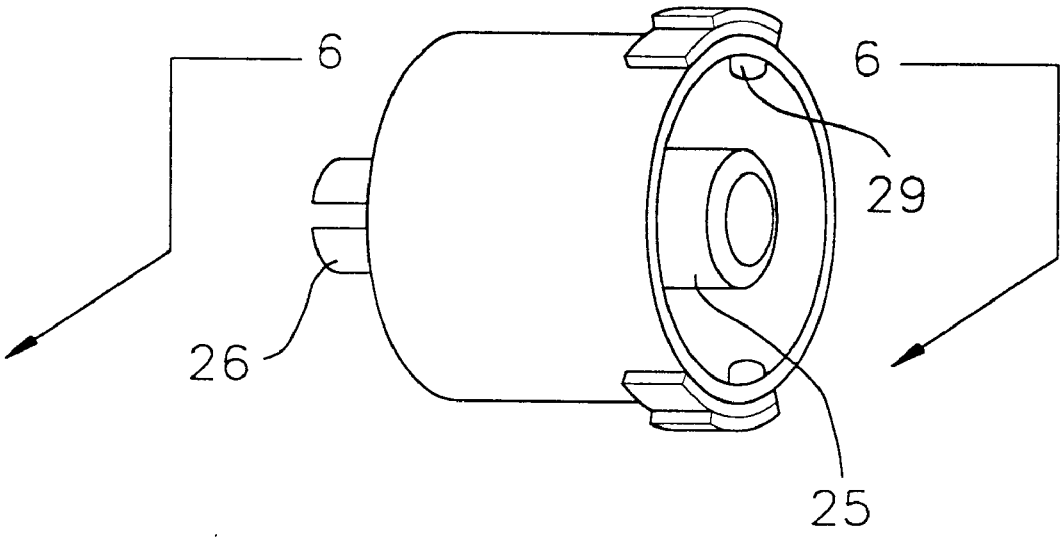
FIG. 6A is a perspective view of a coupling member used for the inventive shower unit in accordance with a first preferred embodiment of the present invention.
Figure 6B:
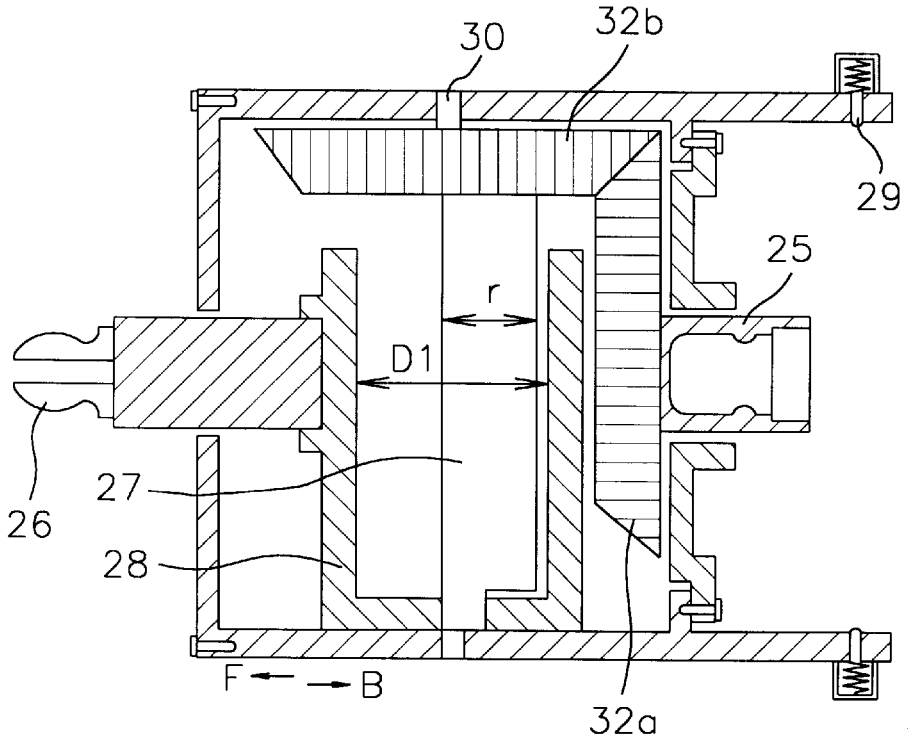
FIG. 6B is a sectional view of the coupling member taken along line 6—6 of FIG. 6A.

FIGS. 6A and 6B each depict a coupling member 6A which converts the rotation of the rotary shaft 12 of the rotator 4 into straight-line reciprocating motion of the cleaning unit 7. A connector 26, integrally joined to the rotary shaft 12, is inserted into an insertion hole 25. As the insertion hole 25 rotates, a driving bevel gear 32*a* goes into action to turn a passive bevel gear 32*b*. As the passive bevel gear 32*b* turns, the rotary shaft 30 rotates, thus turning a cam 27 that is provided to the rotary shaft 30. A cylinder 28, disposed to be rotatable about the cam 27, is moved in a direction of arrow F or B of FIG. 6B by the rotation of the cam 27. Therefore, the connector 26 moves forward and backward. The rectilinear movement of the cylinder 28 is possible by making the radius "r" of the rotating cam 27 larger than the inside diameter $D_1$ of the cylinder 28.

Figure 7:
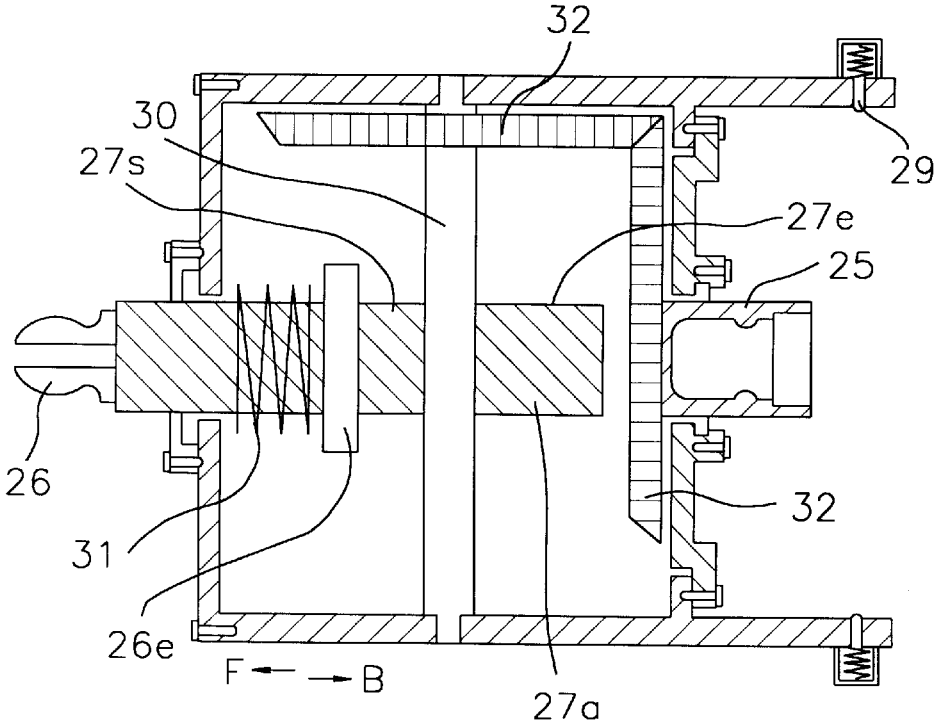
FIG. 7 is a sectional view of another coupling member taken along line 6—6 of FIG. 6A.

FIG. 7 illustrates another preferred embodiment of a coupling member 6A. When a long portion 27*e* of a cam 27*a* that is provided to the rotary shaft 30 comes in contact with the rear end 26*e* of the connector 26, the connector 26 is moved in the direction of the arrow F against a tension of the spring 31. If a short portion 27*s* of the cam 27*a* touches the rear end 26*e* of the connector 26, the connector 26 is moved in the direction of the arrow B by the spring 31.

Figure 8A:
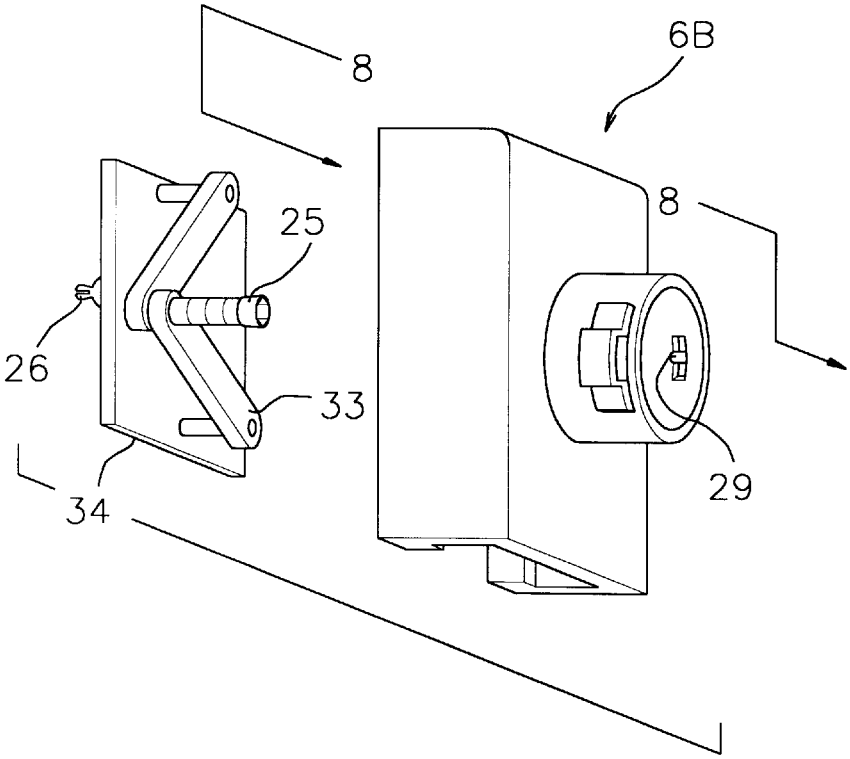
FIG. 8A is a perspective view of a coupling member used for the inventive shower unit in accordance with a second preferred embodiment of the present invention.
Figure 8B:
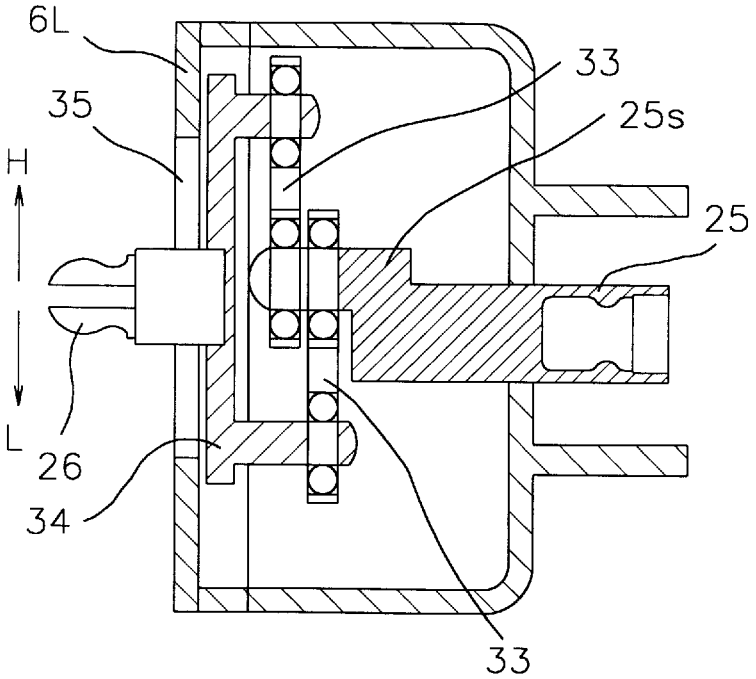
FIG. 8B is a sectional view of the coupling member taken along line 8—8 of FIG. 8A.

FIGS. 8A and 8B each depict a coupling member 6B which converts the rotation of the rotary shaft 12 of the rotator 4 into straight-line reciprocating motion of the cleaning unit 7. An offset shaft 25*s* is formed on one end of an insertion hole 25 that faces the connector 26. An upper rod 33H and a lower rod 33L are arranged to make a sliding panel 34 move in the direction of the arrows H and L when the offset shaft 25*s* rotates about the rotary shaft of the insertion hole 25. Thus, the connector 26, integrally connected with the sliding panel 34, moves into a guide groove 35 which is formed on a front cover 6L.

Figure 9A:
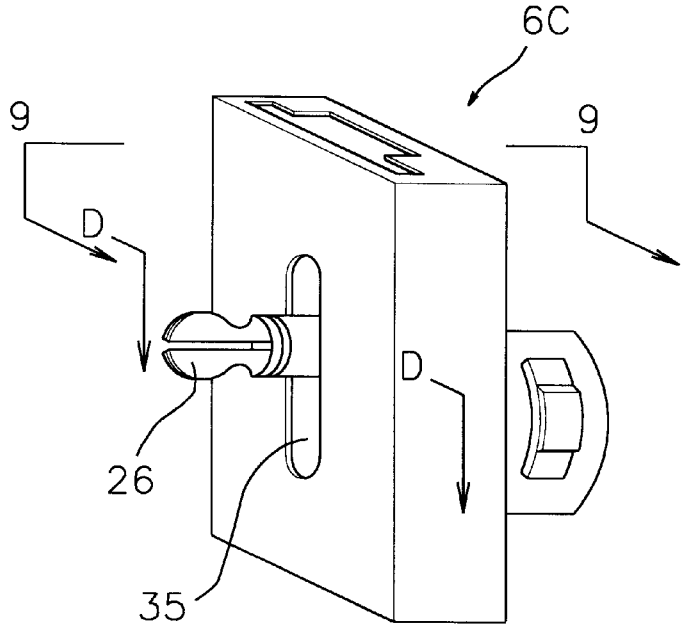
FIG. 9A is a perspective view of a coupling member used for the inventive shower unit in accordance with a third preferred embodiment of the present invention.
Figure 9B:
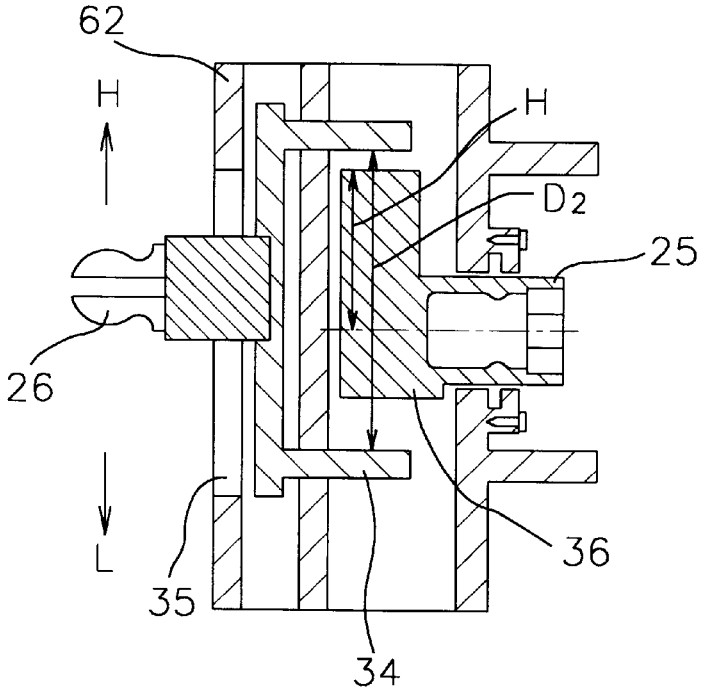
FIG. 9B is a sectional view of the coupling member taken along line 9—9 of FIG. 9A.

FIGS. 9A and 9B depict other preferred embodiments of the coupling member 6B, respectively.

A cam 36 is disposed in front of an insertion hole 25 of the coupling member 6C. The sliding panel 34 moves in the direction of the arrow H or L by making the height "H" of the rotating cam 36 larger than the inside diameter $D_2$ of the sliding panel 34. Accordingly, the connector 26, integrally provided to the sliding panel 34, moves into a guide groove 35 in the direction of the arrows H and L.

Figure 10:
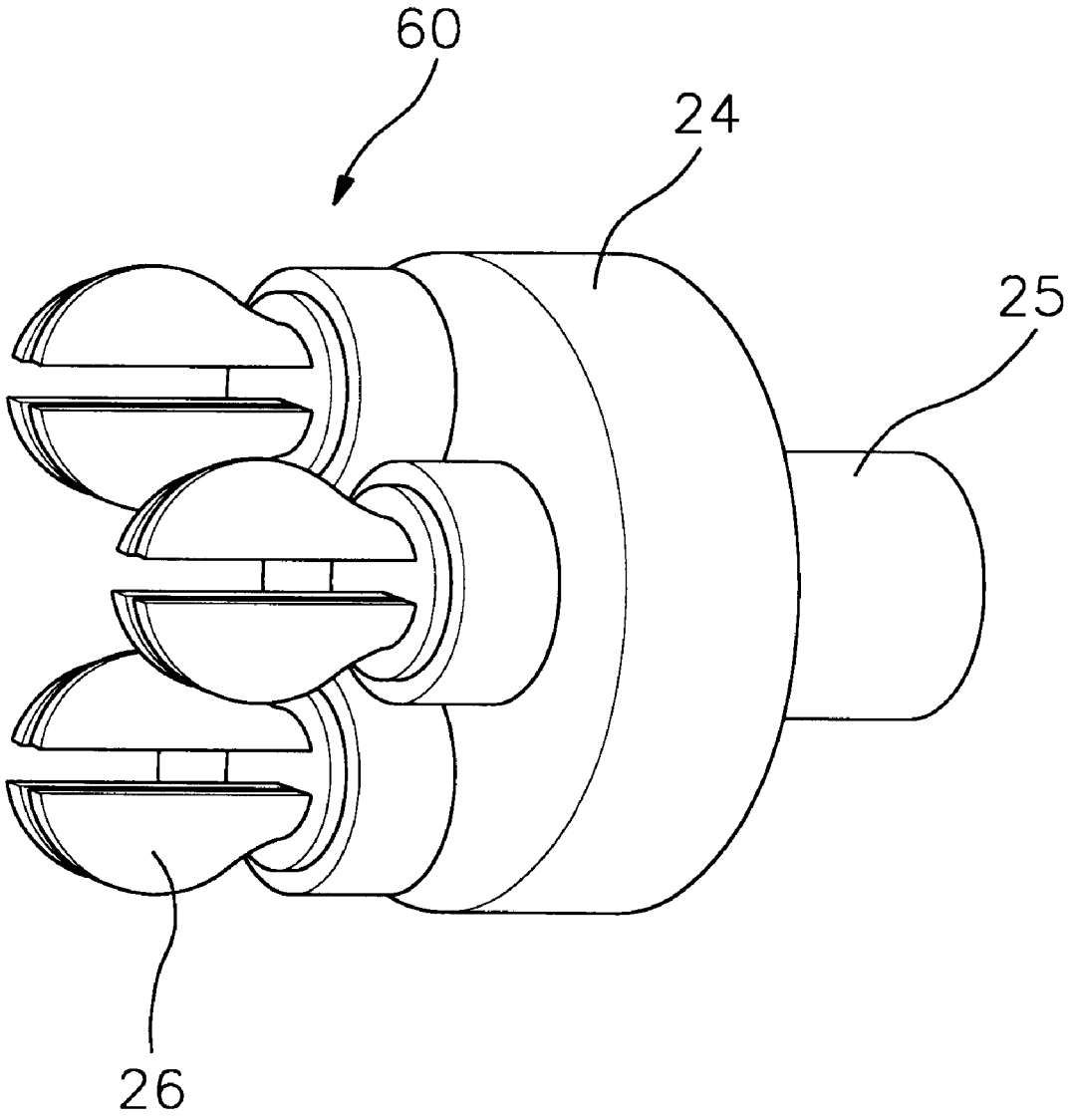
FIG. 10 is a perspective view of a coupling member used for the inventive shower unit in accordance with a fourth preferred embodiment of the present invention.

FIG. 10 depicts a coupling member 6D which converts the rotation of the rotary shaft 12 to the revolution of the cleaning unit 7 around the central axis of the insertion hole 25. A rotary disk 24 is formed to rotate, integrally joined to the insertion hole 25. A plurality of connectors 26 are formed on the front of the rotary disk 24. The connectors 26 are arranged on different spots about the central axis of the rotary disk 24. As the rotary disk 24 turns, each connector 26 revolves about the central axis of the rotary disk 24. Thus, the cleaning unit 7 that is coupled to the connectors 26 rotates about the central axis of the rotary disk 24, too.

Figure 11:
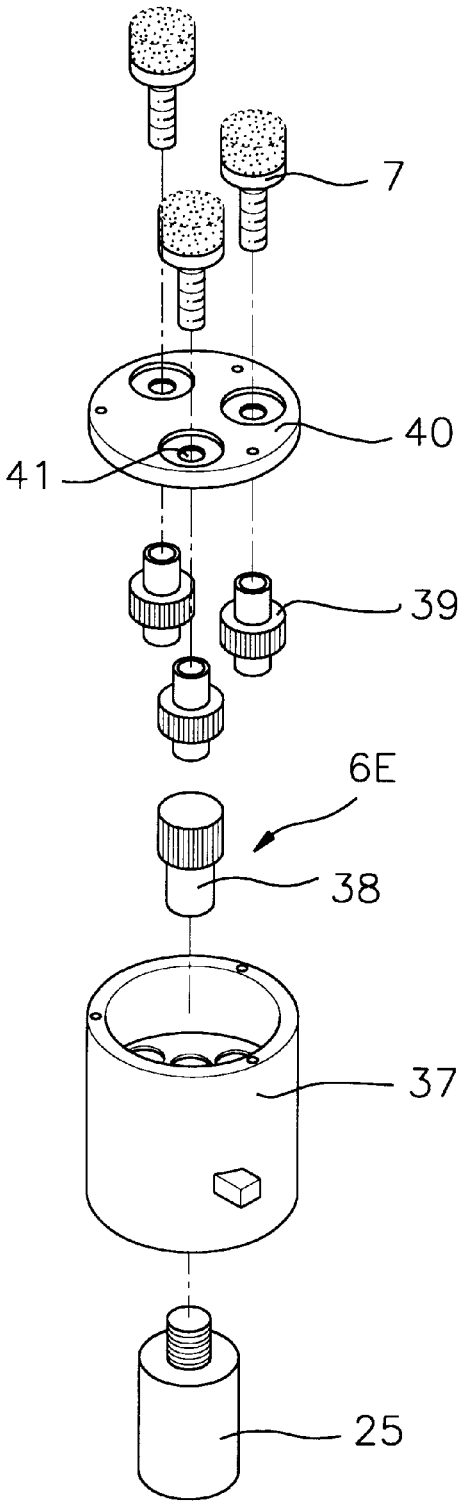
FIG. 11 is an exploded-perspective view of a coupling member used for the inventive shower unit in accordance with a fifth preferred embodiment of the present invention.

FIG. 11 illustrates a coupling member 6E which converts the rotation of the rotary shaft 12 to the revolution of the cleaning unit 7 around the central axis of the insertion hole 25. One end of the insertion hole 25 into which the connector 20 of the rotator 4 mates, is inserted into a case 37 and spirally coupled with a sun gear 38. A plurality of planetary gears 39 are positioned about the sun gear 38 to mesh with the sun gear 38. The planetary gears 39 are connected with each cleaning unit 7 through corresponding insertion holes 7 formed on a cover 40. Therefore, the rotating force of the rotator 4 is transmitted to the sun gear 38 through the insertion hole 25, and as the planetary gears 39 rotate by the rotation of the sun gear 38, each of the cleaning units 7 rotates about its central axis.

The following description concerns the operation of the shower unit having such a construction.

The air that is compressed by the compressor 1 and stored in the tank 2 is provided to the rotator 4 through the air supply tube 3, by opening the control valve 8, at any time when a user requires. Preferably, an extra switch (not illustrated) is installed between the compressor 1 and the tank 2 to control the power applied to the compressor 1 according to the magnitude of the pressure of the air, thus maintaining the pressure of the compressed air at a predetermined magnitude.

Once a user pushes the open/close lever 16, the open/close valve 17 is pressed to open the air supply passage 10. The compressed air is applied to the blade 11 through the air supply passage 10. If the user releases the open/close lever 16, the open/close valve 17 shuts the air supply passage 10 by the elastic force of the spring 18, and stops the compressed air from being supplied to the blade 11. Therefore, the user may operate the cleaning unit of the shower unit when he wants to use it, by manipulating the open/close lever 16.

The compressed air furnished to the rotator 4 turns the rotary shaft 12, simultaneously rotating the blade 11. The rotating force of the rotary shaft 12 is applied to the cleaning unit 7, making the connector 20 rotate. Thus, the user may wash a certain region of his body with the cleaning unit 7 of the shower unit without using his hands just by manipulating the open/close lever 16.

The compressed air rotating the rotary shaft 12 is discharged to the exhaust passage 13, and passes through the silencer 9 by way of the exhaust tube 5*a* installed outside the air supply tube 3, resulting little noise.

When a user pulls up the water supply valve 53 of the tap 56 to shower water on a desired portion of his body with the inventive shower unit, the tap water flows to the water passage 51 in the rotator 4 through the water supply tube 3*a* so that the user may use the tap water at any time. When the regulating valve 55 is opened at a user-desired time, the tap water that is in the water passage 51 is discharged to the outside via the orifices 50*a* to be supplied to a region of his body.

When a user tries to use the inventive shower unit on a region of his body which is out of his reach, he pulls down the sliding member 23, positioned around the exhaust tube 5*a,* in the opposite direction of the rotator 4 to make a catch 5*b,* provided on the sliding member 23, mate into a recess 23*a,* formed on the sliding member 23, thus preventing the sliding member 23 from moving freely. Accordingly, the rotator 4 extends protrudingly by the length of the sliding member 23. This allows the user to readily reach a region of his body that was beyond his reach with the conventional shower unit.

When cleaning the body, a user may select one of the various cleaning units, each shown in FIGS. 4A to 4H, according to a desired task.

Another motion of the cleaning unit rather than the rotary motion can be attained by interposing the coupling member between the cleaning unit 7 and the rotator 4. That is, in order to remove corneous layers on elbows or heels, a coupling member which allows the cleaning unit that is suitable for this task, to make an up-and-down rectilinear motion, is employed. When a user wants to rub down his back, a coupling member that allows the cleaning unit to either revolve around the rotary shaft or rotate about its central axis, is used for the shower unit. When he wants to massage, a coupling member that lets the cleaning unit move straight forward and backward, is employed. A plurality of protuberances 14 are formed on the outer circumference of the rotator 4 to maintain the secure joint of the rotator 4 and the coupling member.

Figure 12A:
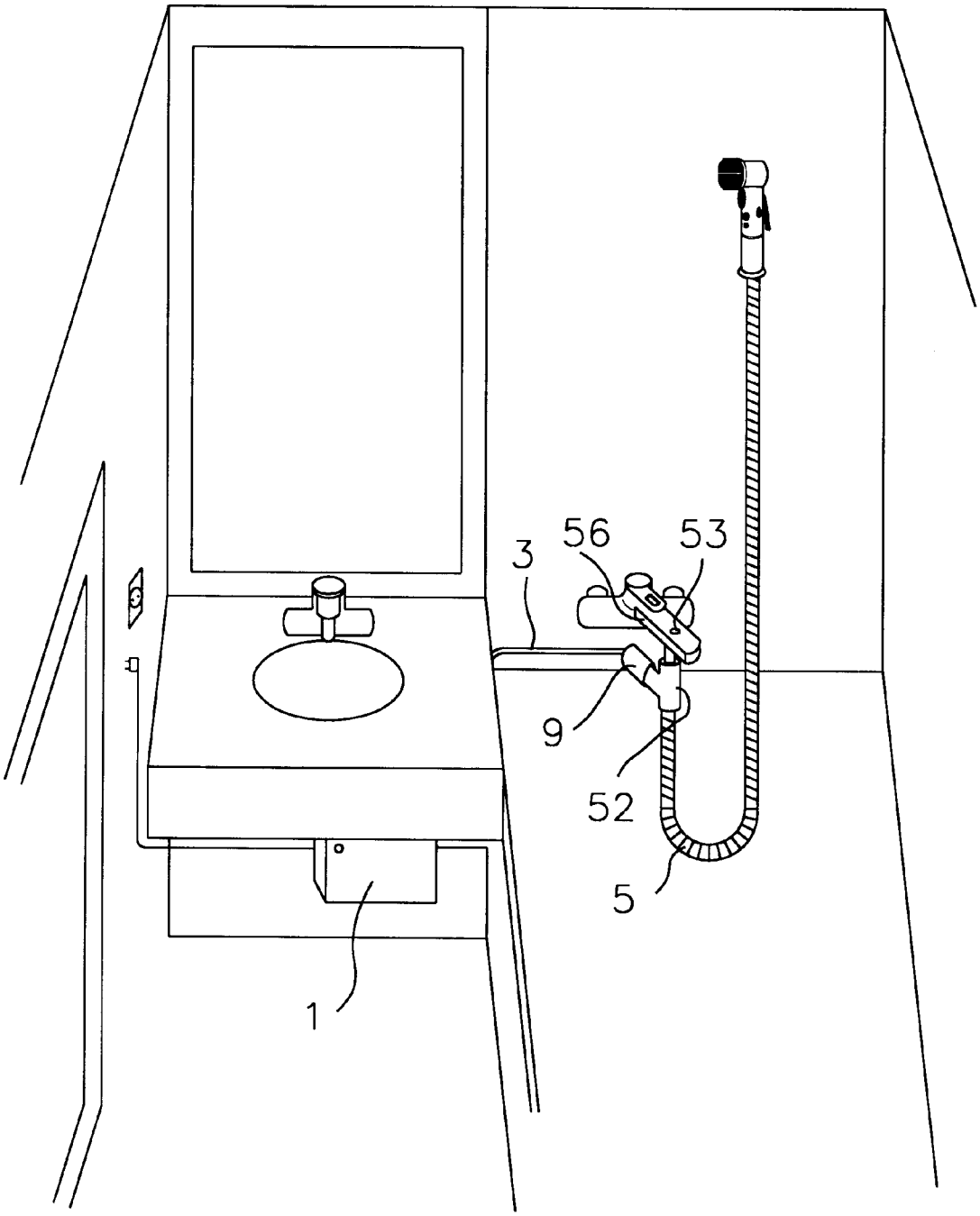
FIG. 12A depicts a bathroom equipped with the inventive shower unit by way of an example.
Figure 12B:
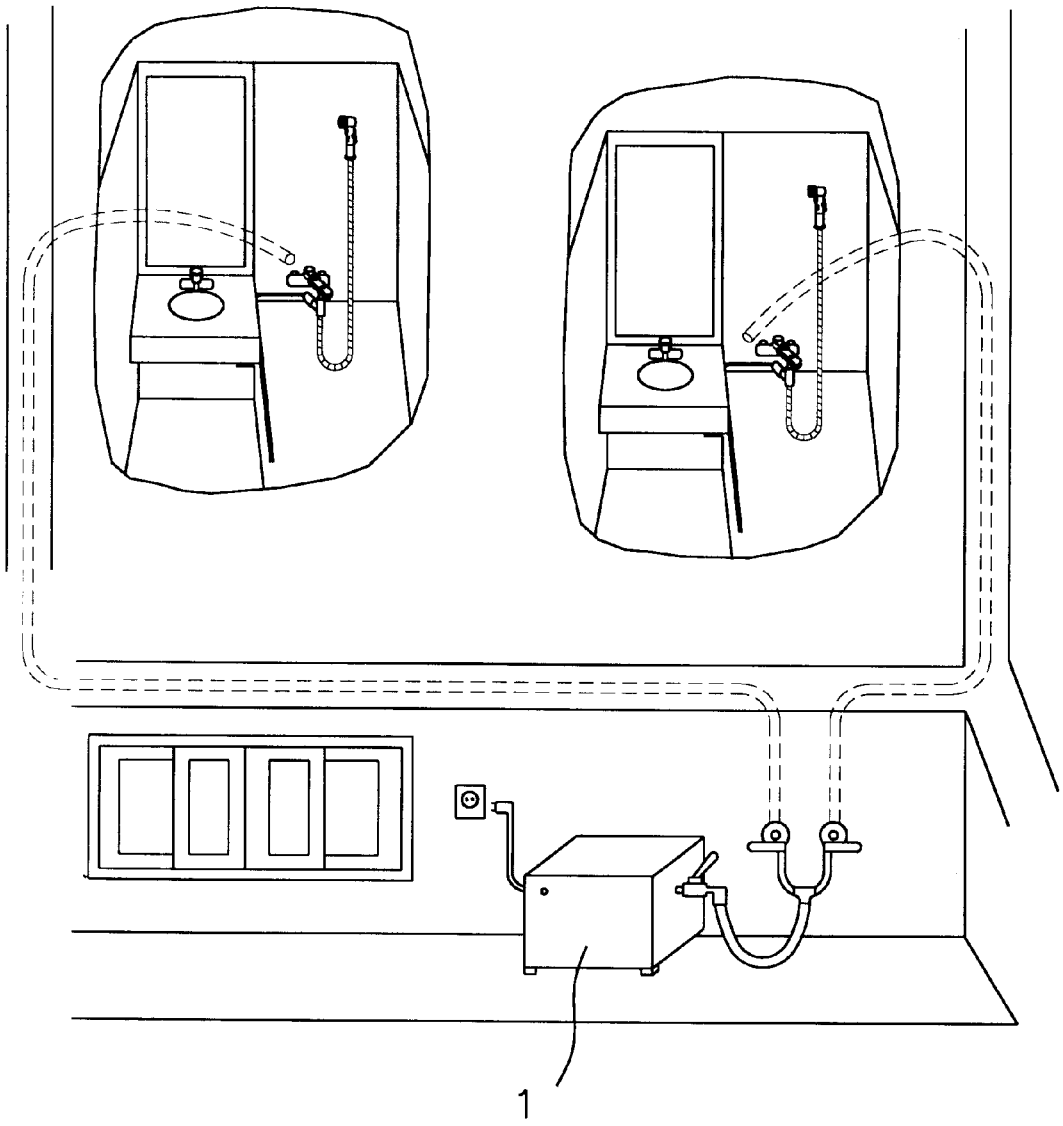
FIG. 12B depicts a bathroom equipped with the inventive shower unit by way of another example.

FIG. 12A shows a set of the inventive shower unit of the above-described construction that is connected to a compressor installed in a bathroom. FIG. 12B depicts several sets of the inventive shower units connected to a compressor provided outside a bathroom.

As described above, according to the present invention, a user may enjoy various functions of the shower unit just by combining each one of the cleaning units and coupling members, or by selecting one of them according to a user-desired task. In the inventive shower unit the cleaning unit rotates automatically by the compressed air, so a user may use the tap water through the inventive single shower unit without an extension hose. Therefore, the present invention provides much convenience to users by removing the trouble of using the extension hose.

What is claimed is:

1. A shower unit comprising:

a generating means for producing high-pressure air for use with the water supply;

a rotating means driven by the high-pressure air;

a silencer positioned at an air exit of the rotating means to reduce air noise, an injecting means positioned near the rotating means to inject tap water; and a cleaning means driven directly by the rotating means.

2. A shower unit as set forth in claim 1, further comprising:

a grip portion including the rotating means and the injecting means, a switch for operating the rotating means, and a valve for controlling the flow of the water sprayed through the injecting means.

3. A shower unit as set forth in claim 2, wherein the injecting means has an outlet facing the cleaning means, and the outlet is formed around the rotary shaft of the rotating means.

4. A shower unit as set forth in claim 2, wherein the injecting means has an outlet facing the cleaning means, and the outlet is formed on the grip portion.

5. A shower unit as set forth in claim 2, wherein the injecting means has an outlet disposed at the opposite side of the rotating means, facing the cleaning means.

6. A shower unit as set forth in claim 1, wherein the cleaning means is formed of brushes.

7. A shower unit as set forth in claim 1, further comprising a coupling means for transmitting a rotating force of the rotating means to the cleaning means.

8. A shower unit as set forth in claim 7, wherein the coupling means is used for converting the rotary motion of the rotating means into the straight-line reciprocating motion of the cleaning means parallel to a rotary shaft of the rotating means.

9. A shower unit as set forth in claim 7, wherein the coupling means is used for converting the rotary motion of the rotating means into the straight-line reciprocating motion of the cleaning means orthogonal to a rotary shaft of the rotating means.

10. A shower unit as set forth in claim 7, wherein the coupling means is used for converting the rotary motion of the rotating means into a revolving motion of the cleaning means with respect to a rotary shaft of the rotating means.

11. A shower unit as set forth in claim 7, wherein the coupling means is used for converting the rotary motion of the rotating means into the rotary motion of the cleaning means with respect to a rotary shaft of the rotating means.

* * * * *